US007704093B2

(12) United States Patent
Turkekole et al.

(10) Patent No.: US 7,704,093 B2
(45) Date of Patent: Apr. 27, 2010

(54) INSULATION-DISPLACEMENT CONNECTION

(75) Inventors: Muhaminet All Turkekole, Minden (DE); Hans-Josef Kollmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 42 days.

(21) Appl. No.: 12/235,930

(22) Filed: Sep. 23, 2008

(65) Prior Publication Data

US 2009/0088019 A1 Apr. 2, 2009

(30) Foreign Application Priority Data

Sep. 27, 2007 (DE) ..... 10 2007 046 616

(51) Int. Cl.
*H01R 11/20* (2006.01)

(52) U.S. Cl. ..... 439/395; 439/389; 439/406

(58) Field of Classification Search ..... 439/395, 439/391, 443, 387, 389, 406
See application file for complete search history.

(56) References Cited

U.S. PATENT DOCUMENTS

| | | | | |
|---|---|---|---|---|
| 3,845,455 | A * | 10/1974 | Shoemaker | 439/399 |
| 4,141,618 | A * | 2/1979 | Reavis et al. | 439/406 |
| 4,186,984 | A * | 2/1980 | Reavis et al. | 439/460 |
| 4,466,682 | A | 8/1984 | Jusseau et al. | |
| 6,796,830 | B2 * | 9/2004 | Suss et al. | 439/409 |

FOREIGN PATENT DOCUMENTS

| | | |
|---|---|---|
| DE | 2 339 800 | 8/1973 |
| DE | 32 39 708 C2 | 4/1982 |
| DE | 35 41 371 A1 | 5/1987 |
| DE | 89 14 739.1 | 12/1989 |
| DE | 199 09 825 A1 | 9/2000 |
| DE | 201 06 523 U1 | 4/2001 |
| DE | 102 00 282 A1 | 1/2002 |
| DE | 20 2006 015 898 U1 | 2/2007 |
| EP | 0 660 441 A1 | 11/1984 |
| EP | 0 660 441 A1 | 6/1995 |

* cited by examiner

*Primary Examiner*—Edwin A. Leon
*Assistant Examiner*—Vanessa Girardi
(74) *Attorney, Agent, or Firm*—Whitham Curtis Christofferson & Cook, PC

(57) ABSTRACT

An insulation-displacement connection having at least one insulation-displacement element (1) with a retaining slot (5), which cuts through an insulation of an electrical conductor with which electrical contact is to be made by the insulation-displacement element (1), in a sleeve body is described. The retaining slot (5) extends continuously from an insertion opening in a longitudinal direction (L) of the sleeve body. The sleeve body has a crosspiece (2) which has two mutually opposite spring limbs (3*a*, 3*b*) integrally adjoining its ends, which spring limbs merge, at their end which is opposite the crosspiece (2), into limb ends (4*a*, 4*b*), which are angled-away so as to face one another, in order to form the retaining slot (5) by way of the free longitudinal side edges of the limb ends (4*a*, 4*b*), so that a conductor accommodation space which is bounded by the spring limbs (3*a*, 3*b*) and the cross-piece (2) is created beneath the retaining slot (5). The spring limbs (3*a*, 3*b*) in each case have at least one slot recess (9*a*, 9*b*) which extends in the direction of the limb end (4*a*, 4*b*) from the crosspiece (2), the width of the said slot recess being matched over the direction of extent to the width of the spring limbs (3*a*, 3*b*) such that an effective width of the spring limbs (3*a*, 3*b*), which tapers from the crosspiece (2) to the longitudinal side edge of the limb ends (4*a*, 4*b*), is produced in the longitudinal direction (L).

14 Claims, 11 Drawing Sheets

INSULATION-DISPLACEMENT CONNECTION

Figure 1:
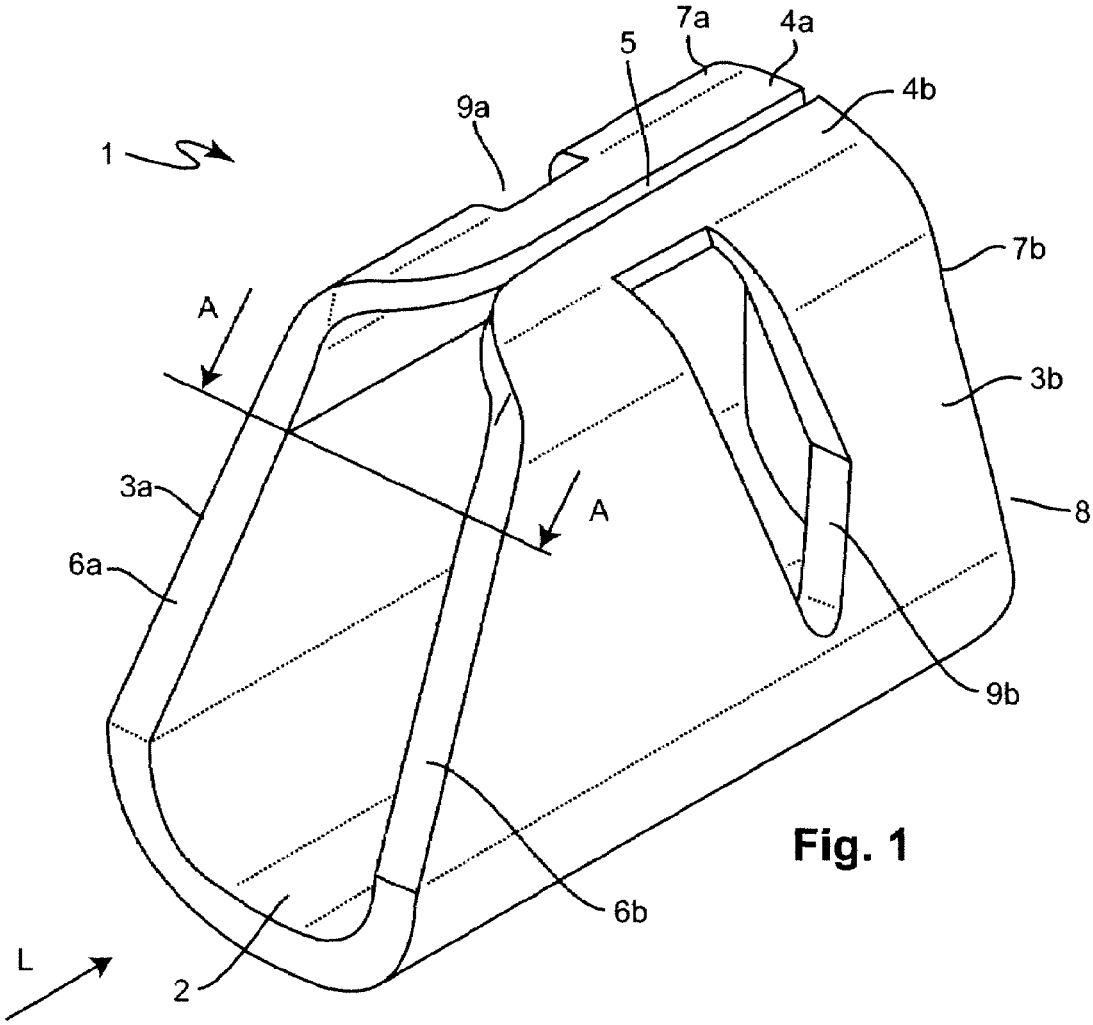

The invention relates to an insulation-displacement connection having at least one insulation-displacement element with a retaining slot, which cuts through an insulation of an electrical conductor with which electrical contact is to be made by the insulation-displacement element, in a sleeve body, with the retaining slot extending continuously from an insertion opening in a longitudinal direction of the sleeve body and the sleeve body having a crosspiece which has two mutually opposite spring limbs integrally adjoining its ends, which spring limbs merge, at their end which is opposite the crosspiece, into mutually facing limb ends in order to form the retaining slot by way of the free longitudinal side edges of the limb ends, so that a conductor accommodation space which is bounded by the spring limbs and the crosspiece is created beneath the retaining slot.

Insulation-displacement connections of this type have the advantage that they can be used to connect an insulated electrical conductor without its insulation first having to be stripped. When the electrical conductor is inserted, the insulation layer is slit open and the electrical conductor which is exposed in this way makes electrical contact with the insulation-displacement element at the mutually facing edges of the limb ends which form the retaining slot. The limb ends are spring-mounted with the aid of the spring limbs, which are situated opposite one another and are connected to one another by means of a crosspiece, so that they are pushed away from one another during insertion of the electrical conductor and are pressed onto the electrical conductors by the spring force which is applied with the aid of the spring limbs.

DE 2 339 800 discloses a sleeve-like clamping element for connecting electrical conductors without stripping the insulation, in which clamping element the clamping seat is divided into at least two sectional regions by at least one incision which runs perpendicular to it. Therefore, two or more electrical conductors can be clamped onto a single sleeve-like clamping element without these electrical conductors influencing each other.

DE 32 39 708 C2 discloses an electrical clamping block with a connecting piece which has two lips which are situated opposite one another and form a retaining slot. Each lip of the retaining slot of a connecting piece is sliced open into two parts by an auxiliary slot in order to form two separate clamping points.

DE 89 14 739 U1 and DE 35 41 371 A1 disclose another embodiment of insulation-displacement contacts in which two cutting blades extend parallel in one plane from a common crosspiece toward an open end and bound a contact-making slot. The cutting blades which are formed in a flat piece of sheet metal each have slot-like recesses, so that insulation-displacement crosspieces are produced between the contact-making slot and each recess, the said insulation-displacement crosspieces bounding the contact-making slot by way of insulation-displacement edges. When a conductor is pushed against the contact-making slot, the insulation-displacement contact limbs can open up to a certain extent by way of their free ends, as a result of which the open end of the contact-making slot can be matched to the diameter of the conductor. When the conductor is pushed into the contact-making slot, the insulation-displacement crosspieces give way as a function of the pressure exerted on them by the conductor and are deformed slightly in the outward direction so as to reduce the width of the recesses. The contact-making slot can therefore be automatically adjusted for conductors of different diameters.

An insulation-displacement element of this type, which is continuously sliced open into two separate clamping regions as far as the retaining slot, is also known from U.S. Pat. No. 4,466,682 A1.

DE 199 09 825 C5 proposes optimizing the design of a sleeve-like clamping element, taking into account the bending stress profile in the clamping state, by the cross section of at least one of the spring limbs of the clamping element being tapered as far as the clamping point. As a result, a uniform profile of the mechanical stress in the spring limbs can be achieved, this being extended in the bending region. The return path can be increased in size in this way.

EP 0 660 441 A1 discloses an insulation-displacement connection of circular cross section with recesses, which extend in the longitudinal direction of the sleeve body, for increasing the flexibility of the retaining slot.

Proceeding from here, the object of the present invention is to provide an improved insulation-displacement connection in which the bending stress profile and therefore the spring characteristic can be matched to the respective requirements by means of structural measures.

The object is achieved with the insulation-displacement connection of the type mentioned in the introduction in that the spring limbs in each case have at least one slot recess which extends in the direction of the limb end from the crosspiece so as to leave free a longitudinal side edge of the limb ends which runs in the longitudinal direction, the width of the said slot recess being matched over the direction of extent to the width of the spring limbs such that an effective width of the spring limb, which tapers from the crosspiece to the longitudinal side edge of the limb ends, is produced in the longitudinal direction, in that the limb ends are angled away from the adjacent spring limb, and in that the slot recesses extend partly into the angled-away limb ends.

It is proposed to create the spring characteristic not by changing the material thickness in the cross section of the spring limbs but rather to provide a slot recess in the spring limbs and to adapt the spring characteristic with the aid of this slot recess. Use is made of the fact that the spring characteristic, inter alia, is not necessarily dependent on the material thickness of the spring limbs but also on the effective width of the spring limbs in the longitudinal direction, it being possible to adapt the said width by means of a slot recess. In addition, the slot recess provides space to accommodate insulating material of the line.

In order to obtain an optimum bending stress profile, it is proposed that the slot recesses extend partly into the angled-away limb ends, so that the spring characteristic, in particular at the transition of the spring limbs to the limb ends, is also adapted in order to ensure the highest possible restoring forces. Therefore, the accommodation space for insulating material which can enter the slot recess is also increased.

According to the teaching of the present invention, the slot recess is therefore adapted in terms of length and shape such that an optimum spring characteristic and therefore an optimum, preferably uniform, profile of the mechanical stress is produced in the spring limbs.

It is advantageous when the limb ends of the insulation-displacement elements are shorter than the crosspiece with the adjoining ends of the spring limbs in the longitudinal direction. As a result, the effective width of the spring limbs already decreases from the crosspiece in the direction of the limb ends on account of this shortening of the limb ends. The slot recess further intensifies the effect of the effective width of the spring limbs which decreases in the direction of the limb end.

The spring limbs are preferably of trapezoidal configuration—in plan view—and in this case may have a kink on at least one side edge of the spring limbs, at which kink the side edge which runs obliquely from the crosspiece in the direction of the limb end in order to form the trapezoidal shape, merges with a section which is continuous as far as the limb end, and is approximately perpendicular relative to the plane of the crosspiece. The trapezoidal shape therefore does not necessarily require a continuous profile of the side edges of the spring limbs. A bent or kinked profile of the side edges of the spring limbs is also feasible for the basic configuration of the trapezoidal shape.

In the kinked embodiment of at least one side edge of the spring limbs, it is advantageous, for the purpose of making the mechanical stress in the spring limbs uniform, when the slot recess has a constant width from the limb end, in the direction of the crosspiece, as far as the level of the kink, and from there is tapered in the direction of the connection of the spring limb to the crosspiece. The width of the slot recess is therefore matched to the effective width, which is present in the respective plane, of the remaining spring limb material, that is to say to the shape of the side edges of the spring limbs.

The insulation-displacement elements can be fixed and electrically connected in various ways which are known per se from the prior art. The subclaims describe advantageous embodiments in this respect.

Figure 2:
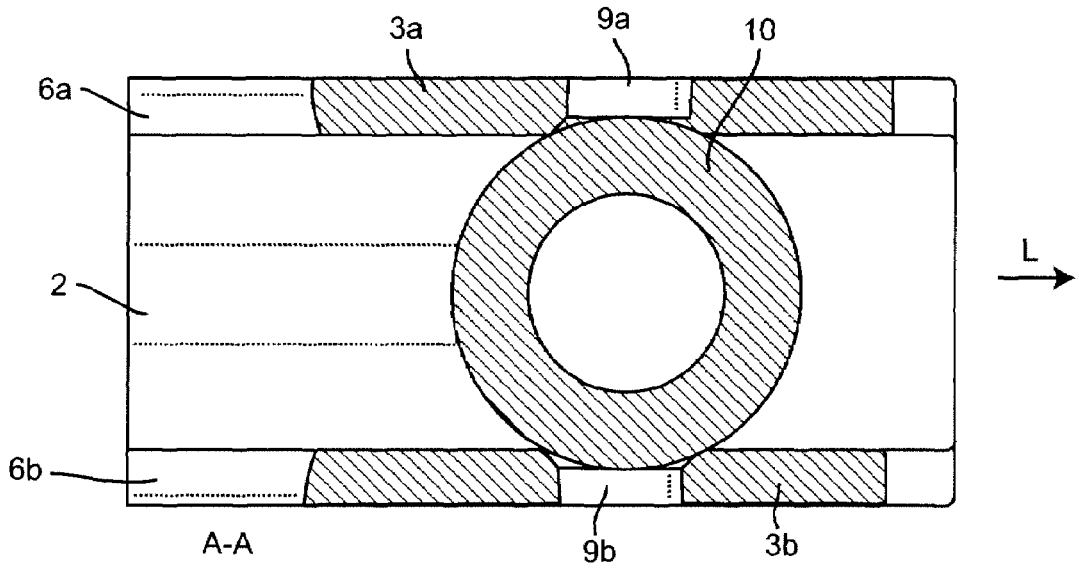
Figure 3:
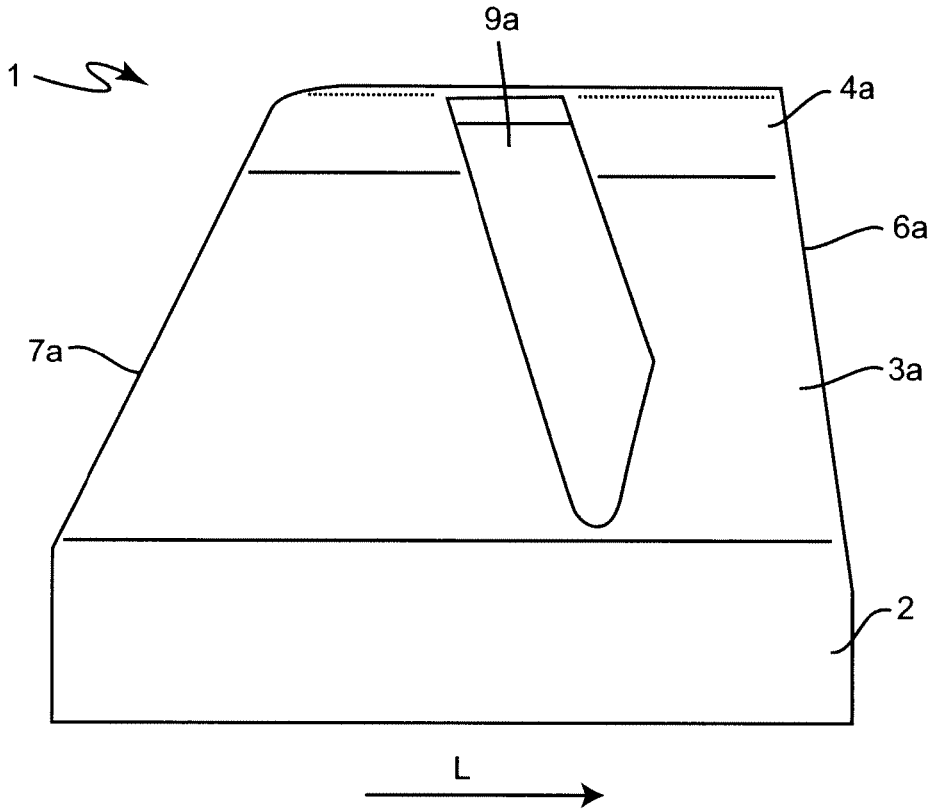
Figure 4:
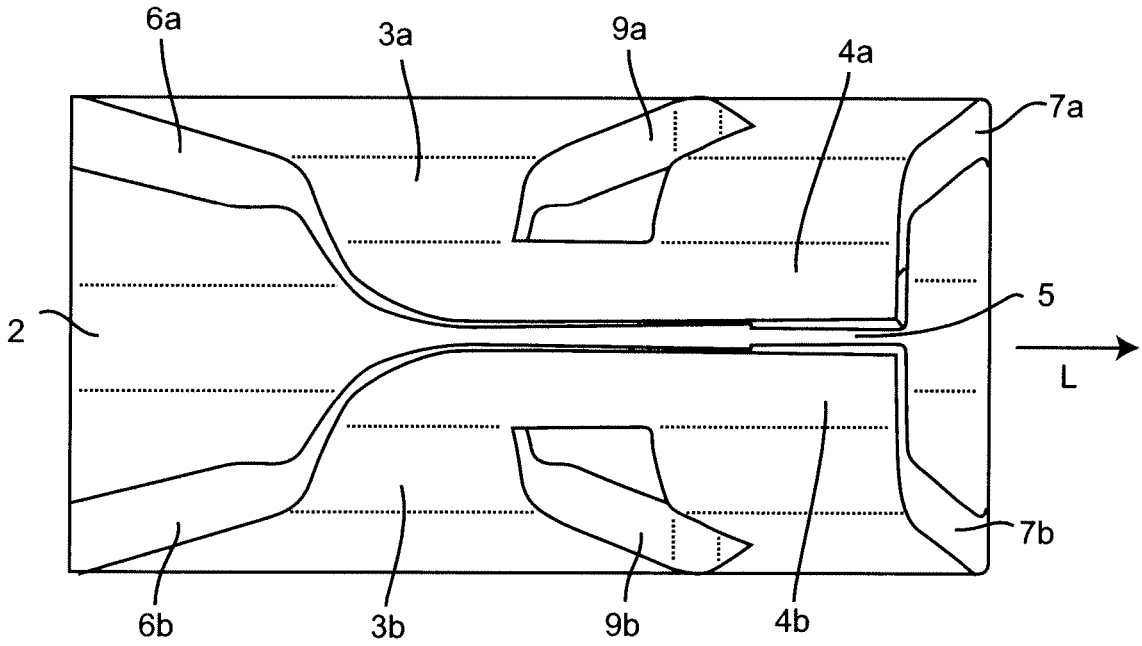
Figure 5:
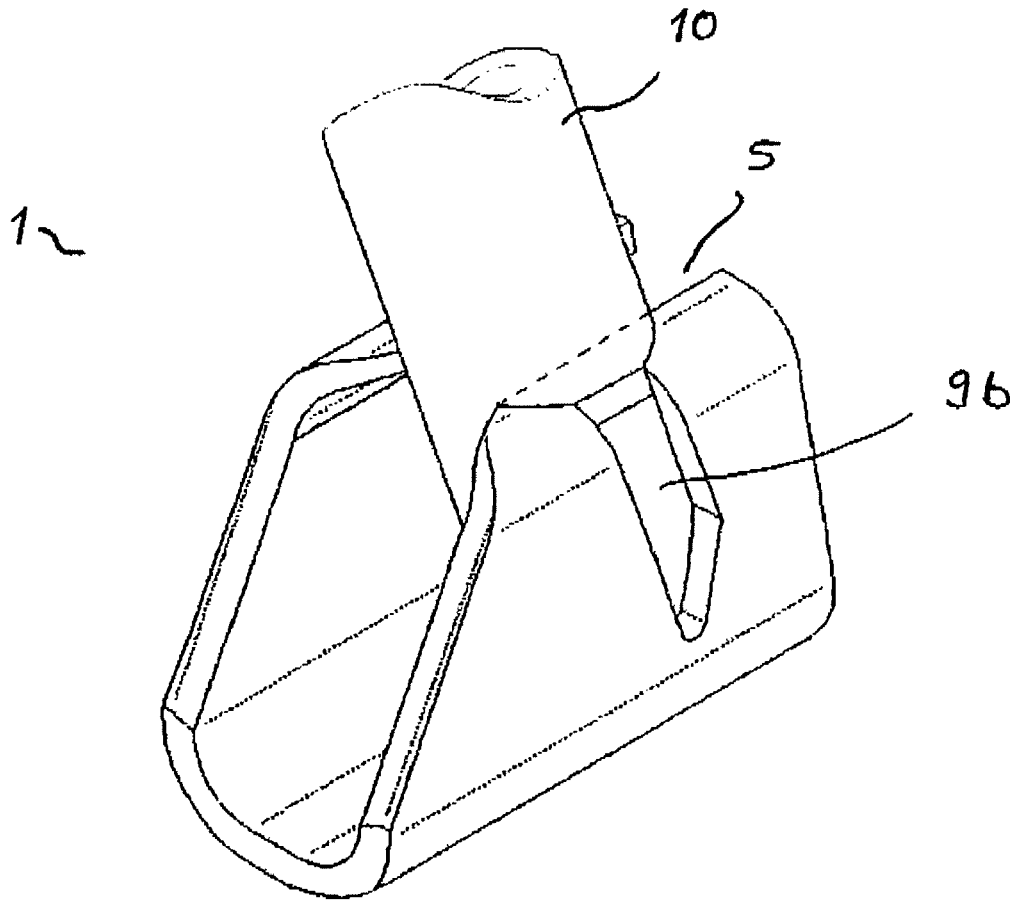
Figure 6:
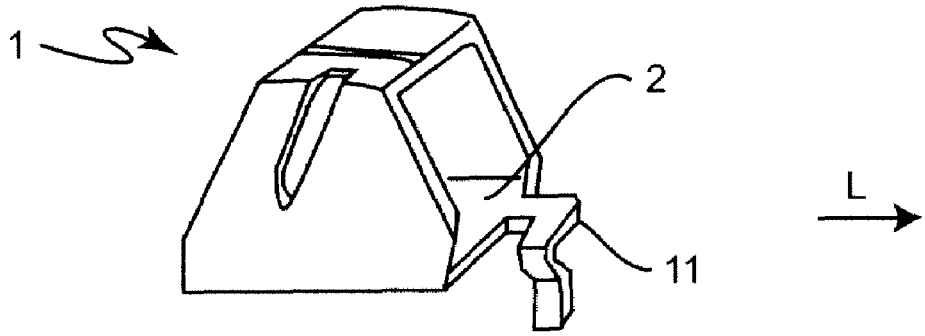
Figure 7:
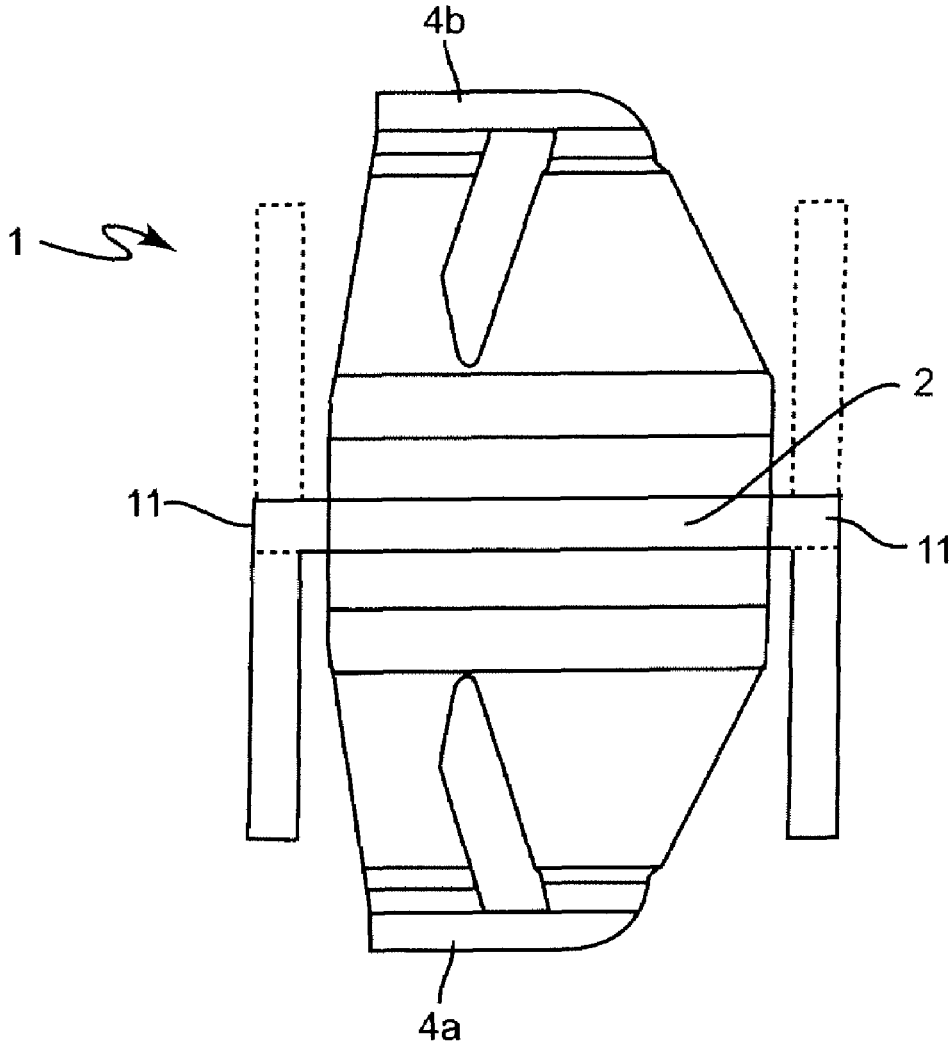
Figure 8:
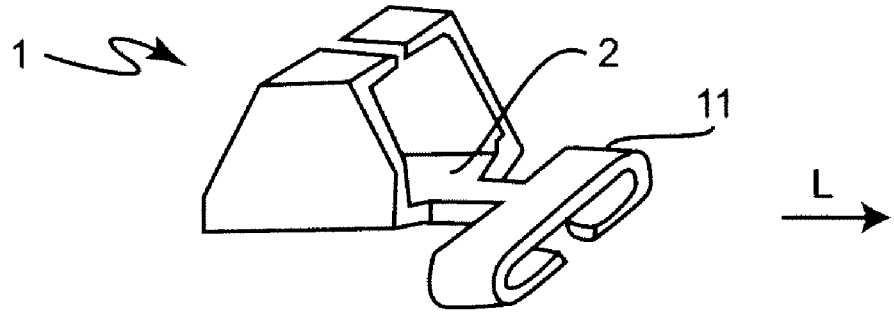
Figure 9:
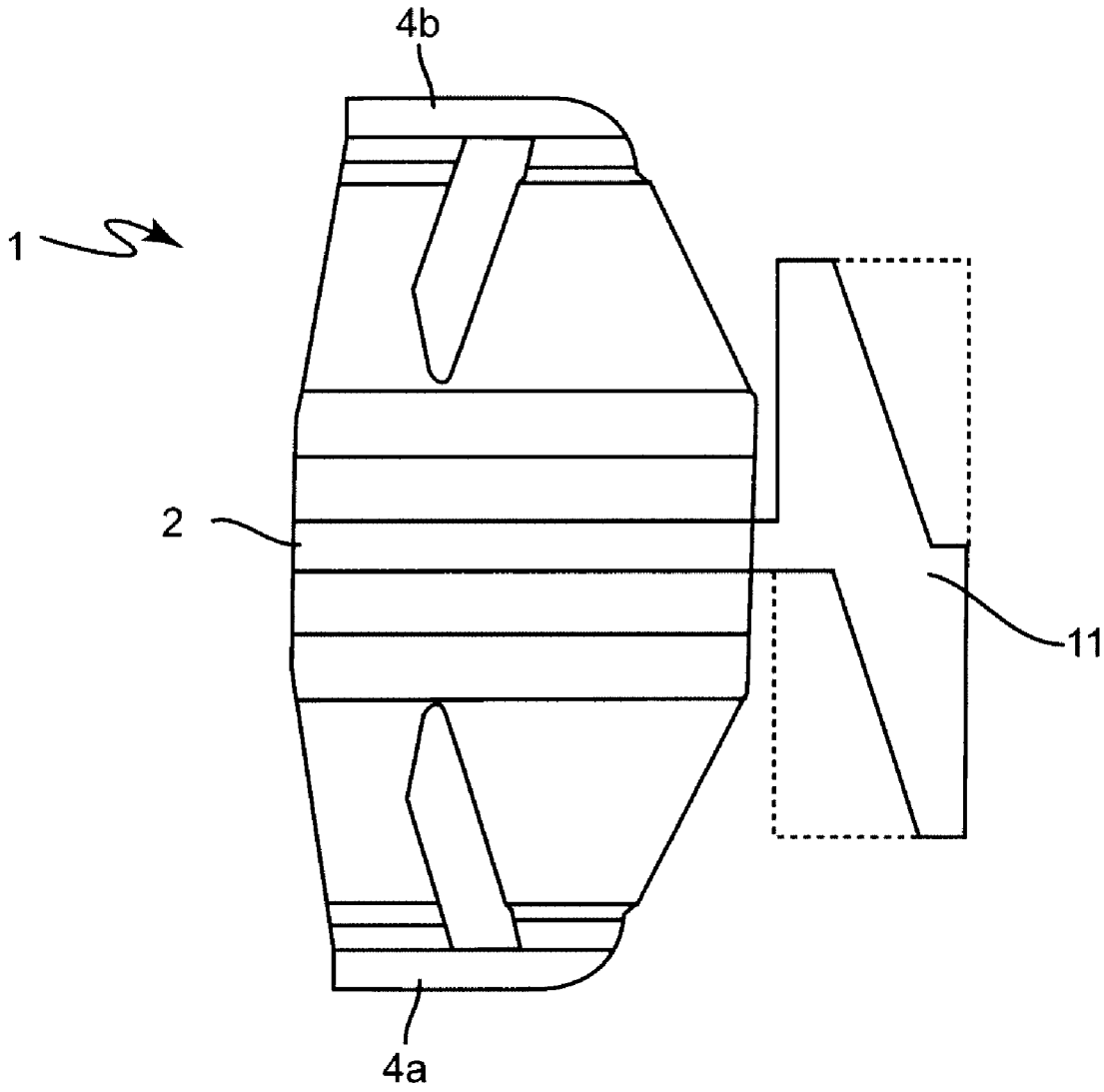
Figure 10:
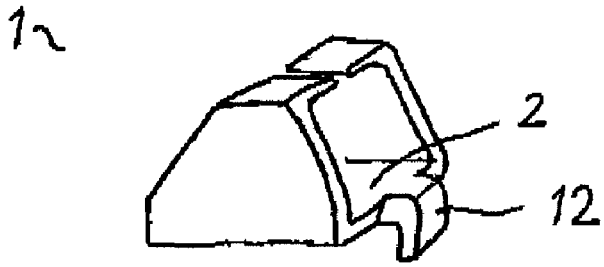
Figure 11:
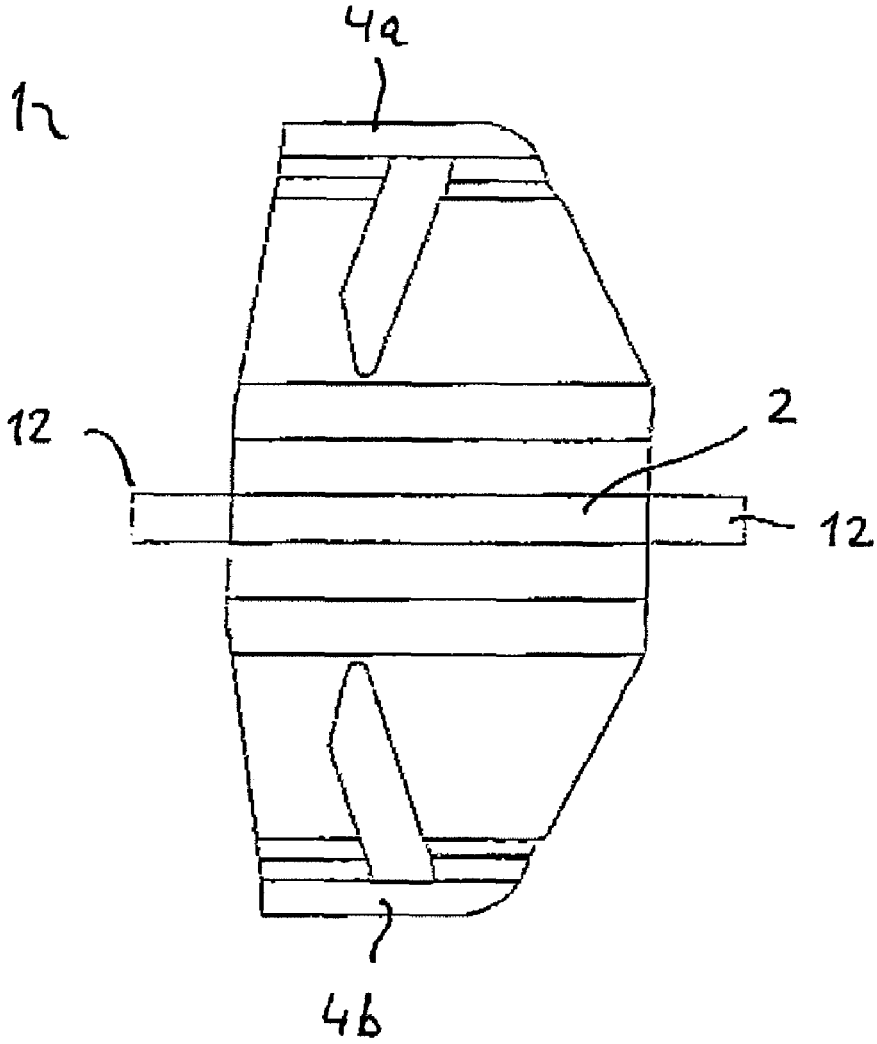
Figure 12:
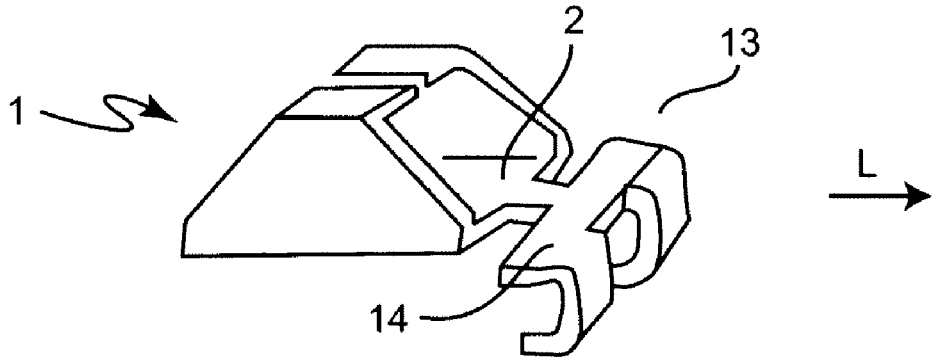
Figure 13:
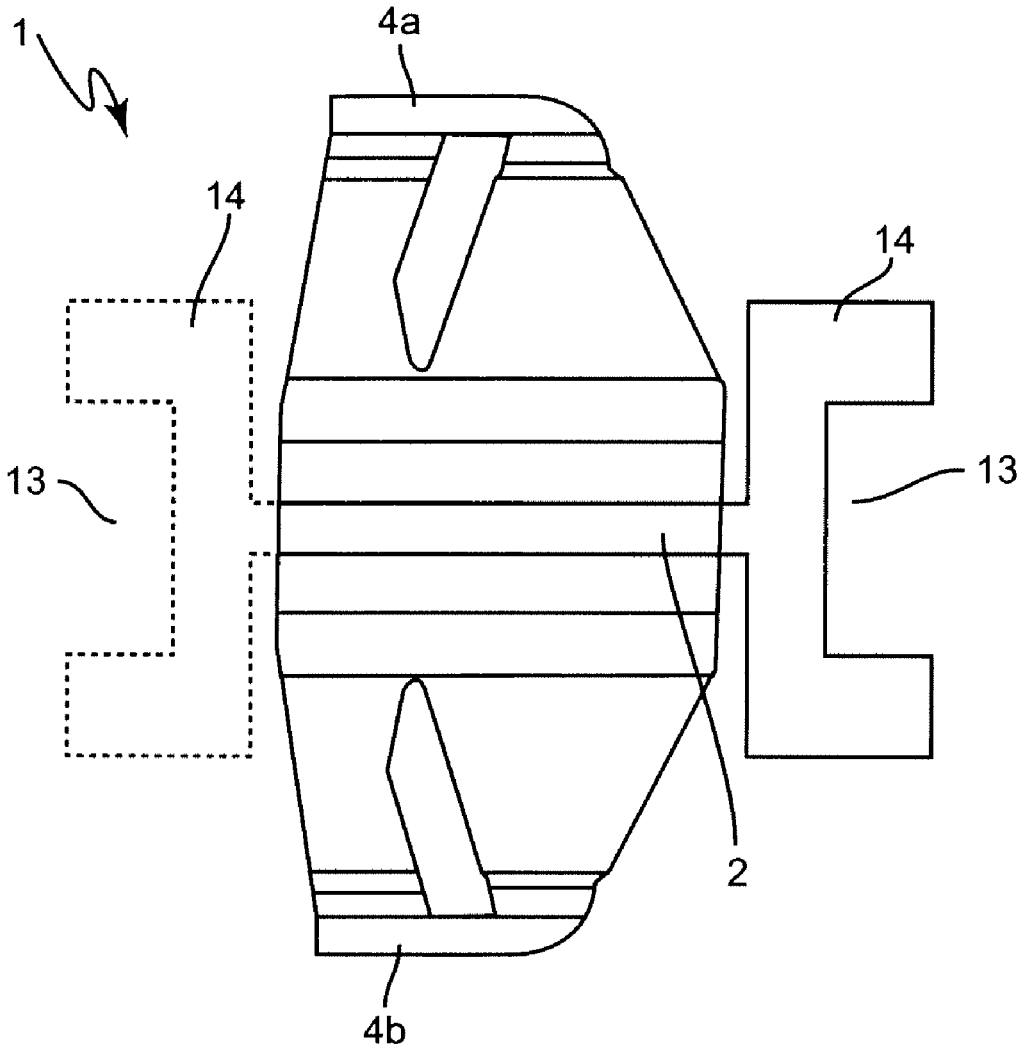
Figure 14:
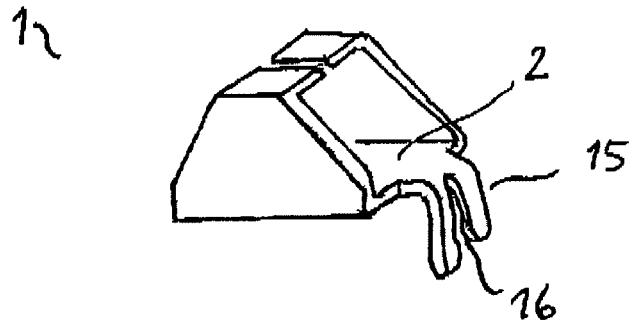
Figure 15:
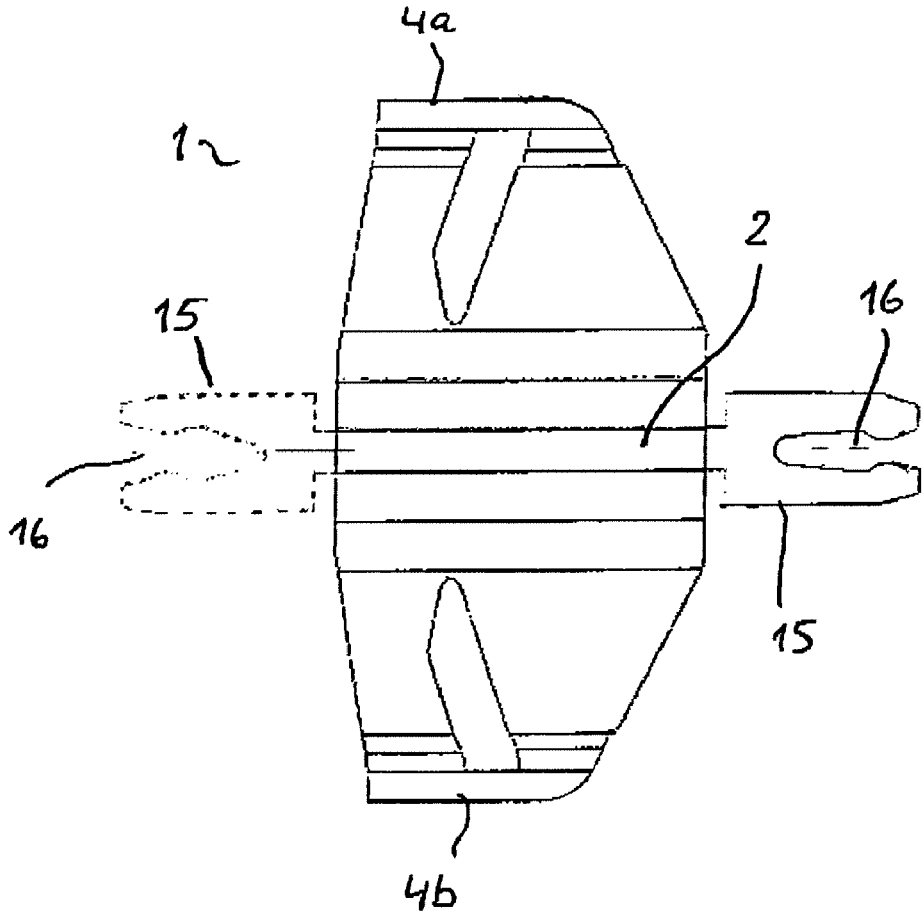
Figure 16:
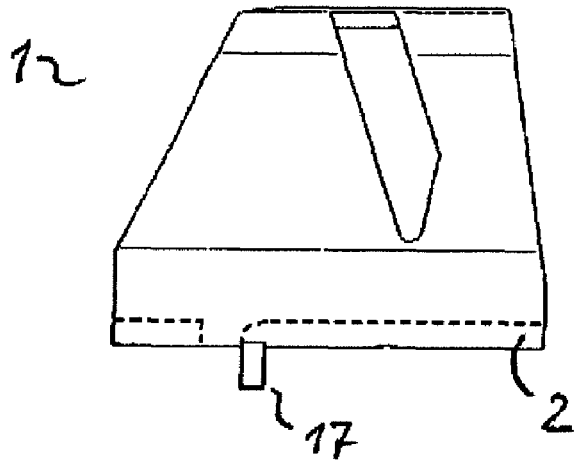
Figure 17:
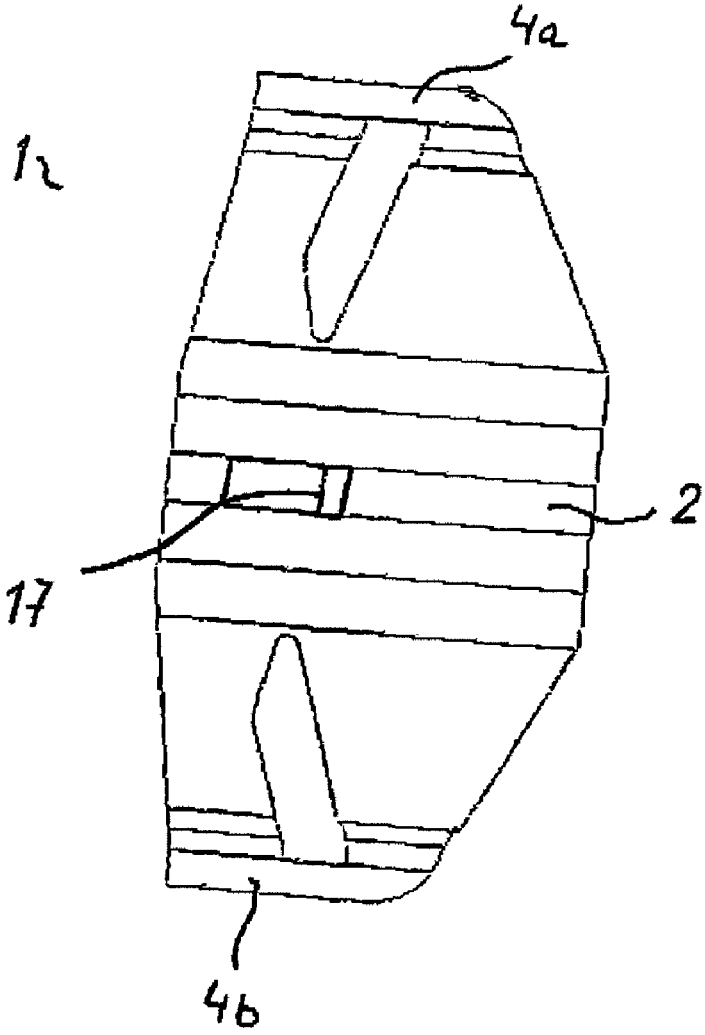
Figure 18:
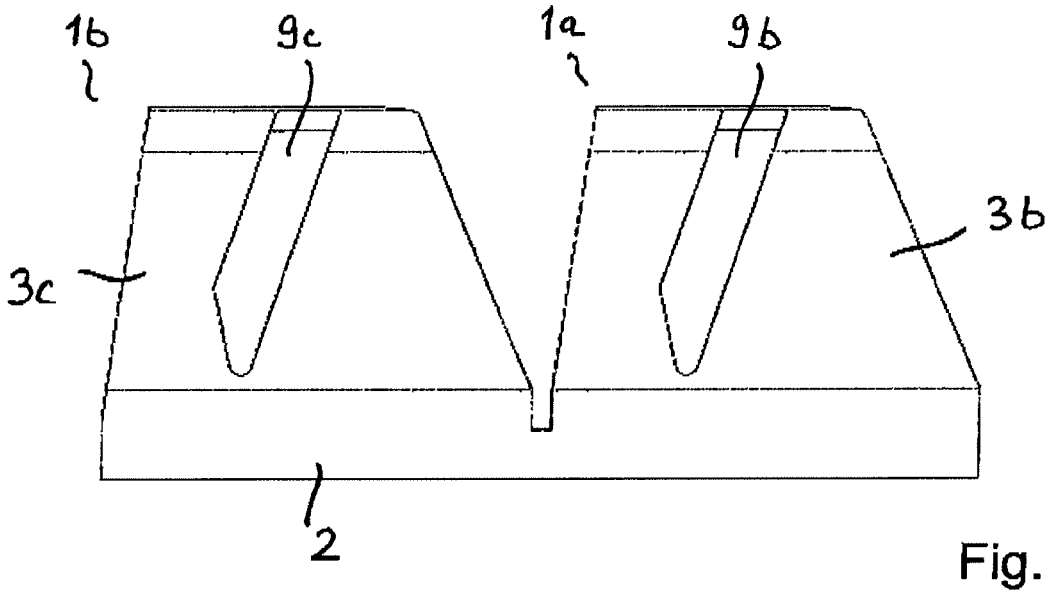
Figure 19:
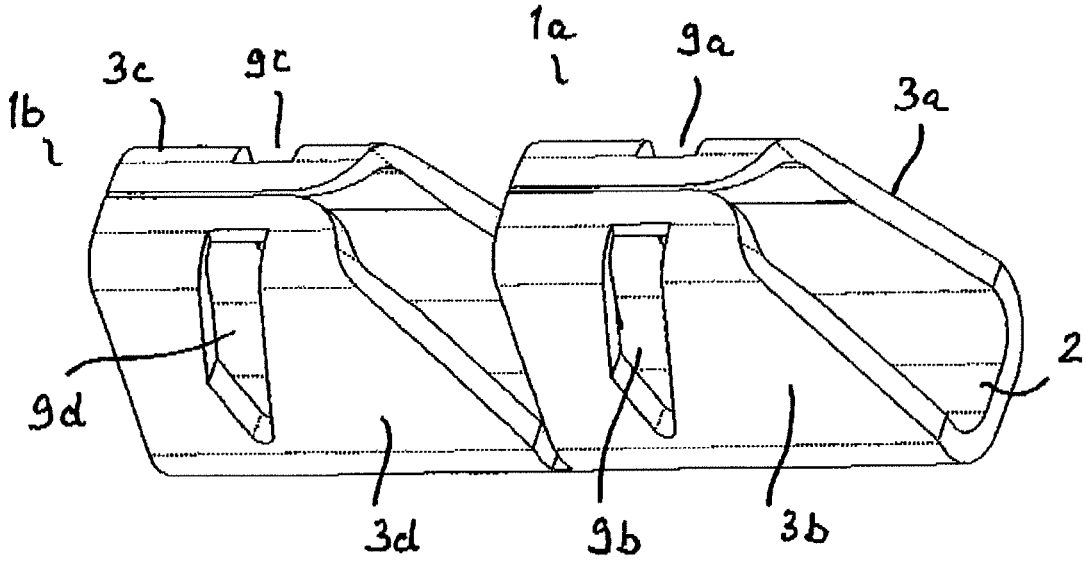
Figure 20:
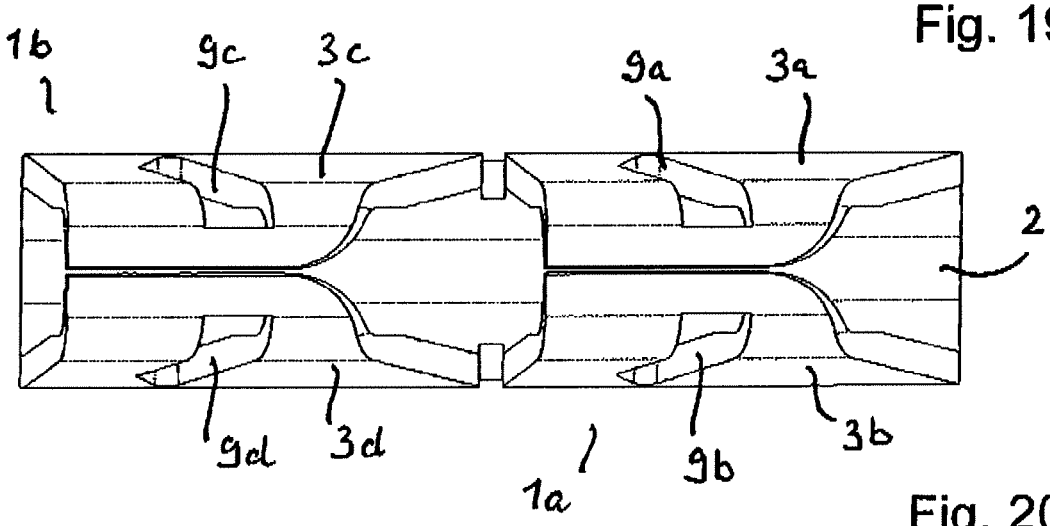
Figure 21:
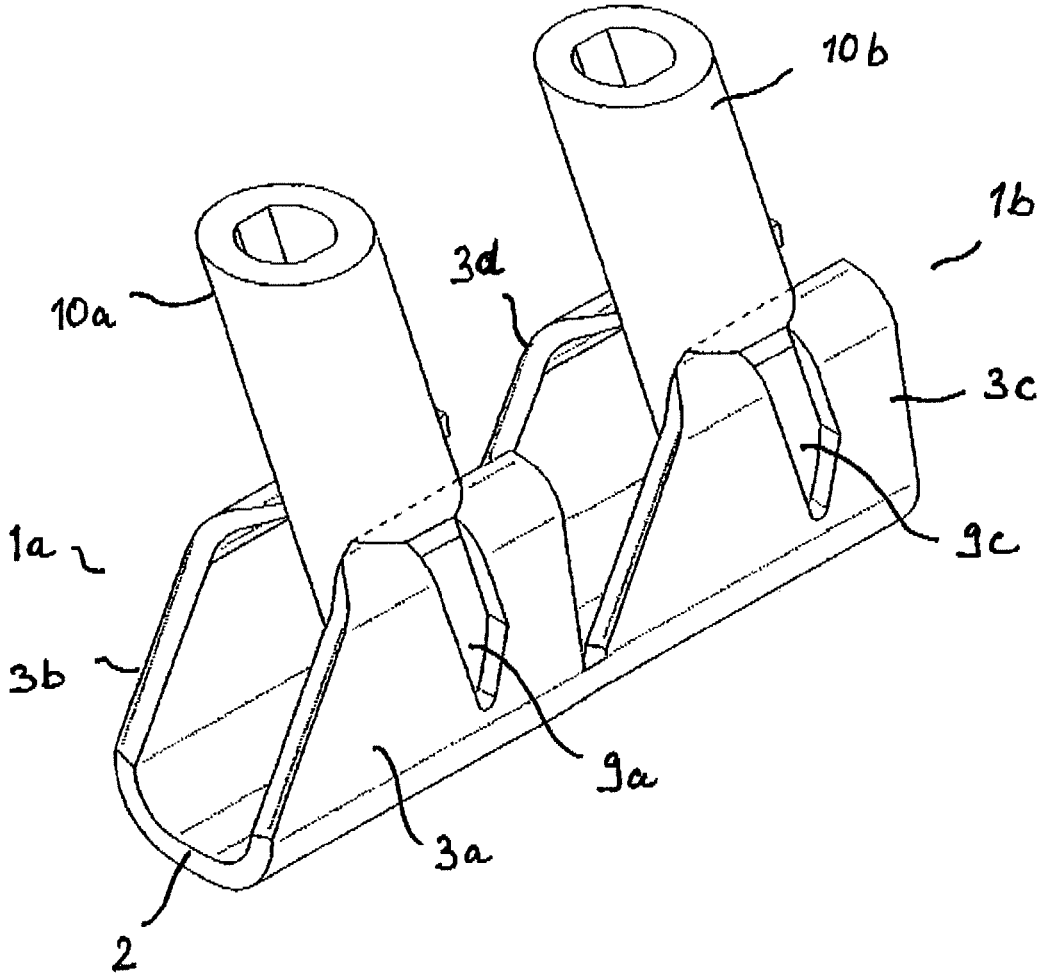
Figure 22:
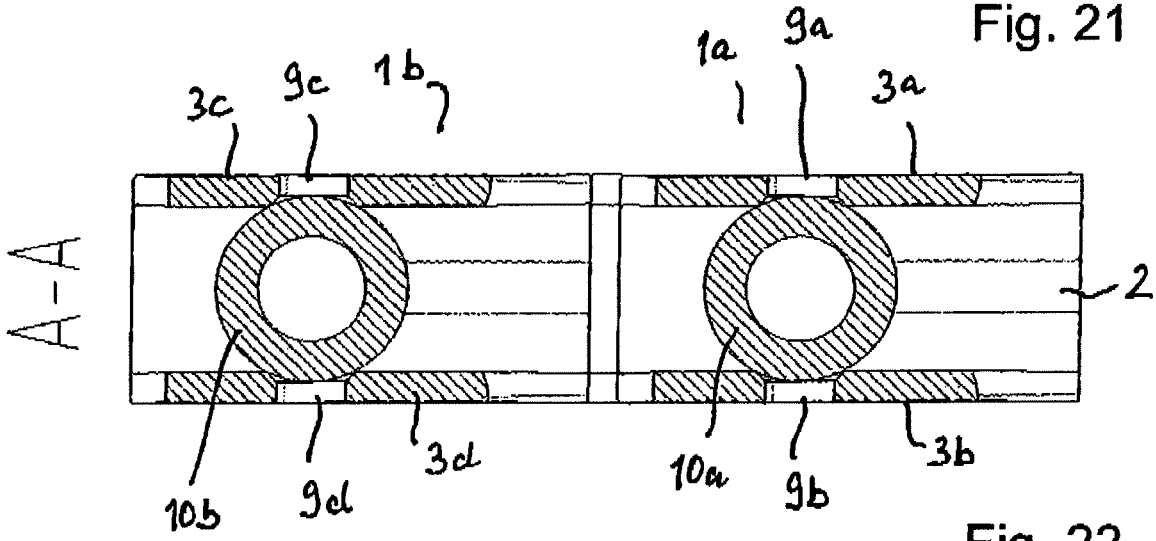

The invention is explained in greater detail below with reference to the exemplary embodiment by way of the appended drawings, in which:

FIG. 1—shows a perspective view of an insulation-displacement element;

FIG. 2—a sectional view of the insulation-displacement element with a conductor inserted;

FIG. 3—shows a front view of the insulation-displacement element with a slot recess in a spring limb;

FIG. 4—shows a plan view of the insulation-displacement element from FIG. 1;

FIG. 5—shows a perspective view of an insulation-displacement element from FIG. 1 with a conductor inserted;

FIG. 6—shows a perspective view of an insulation-displacement element with an angled-away connection lug;

FIG. 7—shows a developed view of the insulation-displacement element with connection lugs on both sides;

FIG. 8—shows a perspective view of an insulation-displacement element with connection lugs bent over to form the pocket;

FIG. 9—shows a developed view of the insulation-displacement element from FIG. 8;

FIG. 10—shows a perspective view of an insulation-displacement element with a connection pin which is bent away from the crosspiece;

FIG. 11—shows a developed view of the insulation-displacement element from FIG. 10 with connection pins arranged on both sides of the crosspiece;

FIG. 12—shows a perspective view of an insulation-displacement element with a folded-over connection lug at its ends on both sides to form the pocket;

FIG. 13—shows a developed view of the insulation-displacement element from FIG. 12;

FIG. 14—shows a perspective view of an insulation-displacement element with a protected connection lug;

FIG. 15—shows a developed view of the insulation-displacement element from FIG. 14;

FIG. 16—shows a side view of an insulation-displacement element with connection tabs which are bent out of the crosspiece;

FIG. 17—shows a developed view of the insulation-displacement element from FIG. 16;

FIG. 18—shows a side view of two insulation-displacement elements which are arranged one behind the other;

FIG. 19—shows a perspective view of the pair of insulation-displacement elements from FIG. 18;

FIG. 20—shows a plan view of the pair of insulation-displacement elements from FIG. 18;

FIG. 21—shows a perspective view of the pair of insulation-displacement elements from FIGS. 18 to 20 with conductors inserted;

FIG. 22—shows a side view of the pair of insulation-displacement elements with a conductor inserted.

FIG. 1 shows a perspective view of an insulation-displacement element 1 which comprises a sleeve body which is formed by a crosspiece 2 with adjoining spring limbs 3*a*, 3*b* and limb ends 4*a*, 4*b* which adjoin the spring limbs 3*a*, 3*b*. The crosspiece 2 is bent in a U shape and is integrally connected to an adjoining spring limb 3*a*, 3*b* at the two ends which are in each case identified by a dashed line. The insulation-displacement element 1 is integrally formed from a material, in particular an electrically conductive metal, for example a chromium-nickel alloy, a copper alloy or a copper-coated spring metal. The spring limbs 3*a*, 3*b* extend from the crosspiece in approximately the same direction upward and are arranged at a distance from one another by the crosspiece 2. A limb end 4*a*, 4*b*, which limb ends point toward one another, in each case adjoins the upper ends of the spring limbs 3*a*, 3*b* at an angle by means of a curved portion, so that the free longitudinal edges of the limb ends 4*a*, 4*b* form a retaining slot 5 for an electrical conductor which is to be inserted into the said retaining slot. The limb ends 4*a*, 4*b* are slightly inclined in relation to one another, so that the opposite external angles of the side edges can be used as a sharp-edged cutting element for slicing open an insulator layer which encases the electrical conductor.

It can also be seen that the spring limbs 3*a*, 3*b* are designed in a substantially trapezoidal manner in such a way that the limb ends 4*a*, 4*b* are shorter than the crosspiece 2 with the adjoining ends of the spring limbs 3*a*, 3*b* in the longitudinal direction L. The side edges 6*a*, 6*b* which run from the crosspiece 2 in the direction of the limb ends 4*a*, 4*b* run obliquely in the illustrated exemplary embodiment, it being possible for the opposite side edges 7*a*, 7*b* to have a kink 8 if required, from which kink the side edges 7*a*, 7*b* extend perpendicular to the limb end 4*a*, 4*b*. However, it is equally also feasible for side edges 6*a*, 6*b* to run straight. The configuration depends substantially on the installation position in an insulating material housing.

A slot recess 9*a*, 9*b*, which does not pass fully through the limb ends 4*a*, 4*b*, is in each case made in the surface of the spring limbs 3*a*, 3*b*, so that the retaining slot 5 is of continuous configuration without an interruption. The insulation-displacement element 1 is therefore not divided into two clamping regions which are separate from one another.

The width of the slot recesses 9*a*, 9*b*, which width is not constant in the direction of extent of the slot recess 9*a*, 9*b*, is matched to the effective width of the spring limbs 3*a*, 3*b* in the respective plane in such a way that a desired spring characteristic, that is to say a desired profile of the mechanical stress in the spring limbs 3*a*, 3*b*, is achieved. This desired profile can be uniform, for example.

In the exemplary embodiment, provision is made, in the case of the trapezoidal spring limbs 3*a*, 3*b*, for the slot recess 9*a*, 9*b* to project into the curved portion between the spring limbs 3*a*, 3*b* and limb ends 4*a*, 4*b* in the upper region. In the lower region, the slot recess 9*a*, 9*b* tapers in the direction of the crosspiece 2 and ends in the manner of a section of a circle at its end.

FIG. 2 shows a view of the insulation-displacement element 1 from FIG. 1 in section A-A with a conductor 10 inserted. It is clear that the insulating material of the conductor 10 partly enters the slot recesses 9*a*, 9*b*; this has the advantage that the insulation-displacement element 1 is not pushed apart by the insulating material 10, which would lead to a reduction in the spring clamping force. The installation width of the insulation-displacement element 1 can therefore be reduced compared to the insulation-displacement elements without a slot recess 9*a*, 9*b* by an amount which equals the possible installation depth of the insulating material into the slot recess 9*a*, 9*b*.

This shape of the slot recess 9*a*, 9*b*, which shape is matched to the effective width of the spring limb 3*a*, 3*b* in the respective plane transverse to the longitudinal direction L, is shown more clearly in FIG. 3.

FIG. 4 shows a plan view of the insulation-displacement element 1 from FIG. 1. It can be seen that the angled limb ends 4*a*, 4*b* which face one another are at a slight angle in relation to one another, so that the lower edge of the side edges of the limb ends 4*a*, 4*b* form a sharp-edged retaining slot 6 with which an insulation of an electrical conductor which is inserted into the retaining slot 5 can be sliced open. It can also be seen that the slot recesses 9*a*, 9*b* do not pass through the limb ends 4*a*, 4*b*, so that the retaining slot 5 is continuous without an interruption. It can also be seen that the length of the retaining slot 5 is less than the length of the crosspiece 2. The curved ends of the limb ends 4*a*, 4*b* create the abovementioned funnel-like insertion region for an electrical conductor.

FIG. 5 shows a perspective view of the insulation-displacement element 1 from FIGS. 1 to 4 with a conductor 10 inserted. It is clear that the cutting element is bent up by the conductor 10 which is inserted into the retaining slot 5. As a result, a spring force is exerted on the electrical conductor located in the insulating material of the conductor 10 and it is ensured that electrical contact is made between the insulation-displacement element 1 and the conductor 10. The insulating material in the region of the retaining slot is sliced open by the retaining slot 5.

FIG. 6 shows a sketch of an embodiment of the insulation-displacement element in which a connection lug 11 is integrally formed with the crosspiece 2, extends away from the crosspiece 2 in the longitudinal direction L in a first section and is bent transverse to the longitudinal direction L in a second section, with the second section lying parallel to the plane spanned by the crosspiece 2. Finally, a section which points downward away from the insulation-displacement connection 1 and can be folded in a curved fashion and forms a solder leg for the electrical connection of the insulation-displacement connection and/or for the mechanical fixing purposes is situated at the free end of the second section.

FIG. 7 shows the insulation-displacement connection 1 from FIG. 6 in a developed view. It is clear that the connection lug can be provided not only on one side of the crosspiece 2, but rather optionally also on both sides. The dashed-line illustration of the developed connection lug is intended to indicate that the solder legs can be bent from the same or the opposite direction.

It is likewise possible to form two solder legs on each side.

FIG. 8 shows a sketch of another insulation-displacement connection by way of another embodiment with the electrical connection. It can be seen that the connection lug 2 has sections which extend transverse to the longitudinal direction L, whose ends are bent over so as to face one another, and which form an accommodation slot, for example for a busbar which can be inserted into said accommodation slot. The connection lugs 11 can be bent over their full area or interleaved in at least one plane.

FIG. 9 again shows a developed view of the insulation-displacement element 1 from FIG. 8. The dashed lines indicate the full-area embodiment and the solid lines indicate the interleaved embodiment.

FIG. 10 shows a sketch of a perspective view of an insulation-displacement element 1 with a solder pin 12 which is integrally formed from the crosspiece 2 and is bent downwards away from the insulation-displacement element 1 beneath the plane formed by the crosspiece 2.

FIG. 11 shows a sketch of a developed view of the insulation-displacement element 1 from FIG. 10. In this case, it is clear that the solder pin 12 can not only be provided on one side, as illustrated in FIG. 10, but also on both sides of a crosspiece 2.

FIG. 12 shows an insulation-displacement connection 1 by way of a further embodiment with a connection tab 13 which is likewise formed with the crosspiece 2 and has a first section which extends in the longitudinal direction L and which is adjoined by a transverse crosspiece 14 which extends transverse to the longitudinal direction L on both sides. Fingers which are folded over downward beneath the crosspiece 2 are provided at the ends of the transverse crosspiece 14. The folded-over fingers can be connected, for example, to a busbar.

A similar embodiment is also feasible, in which the centrally arranged solder pin from the embodiment illustrated in FIG. 10 is curved so as to form the pocket in the manner sketched in FIG. 12.

FIG. 13 shows a sketch of a developed view of the insulation-displacement element 1 from FIG. 12.

FIG. 14 shows a sketch of an insulation-displacement element 1 by way of a further embodiment of a connection lug 15 which has a slot 16 which is open at the bottom. The connection lug 15, which is likewise integrally formed with the crosspiece 2, is bent away downward beneath the plane formed by the crosspiece 2. The slotted connection lug 15 can be inserted into a matching slot in a busbar and therefore be mechanically and electrically connected by a press-fit connection. Subsequent soldering is also feasible.

FIG. 15 shows a sketch of a developed view of the insulation-displacement element 1 from FIG. 14. It can be clearly seen that the slot 16 has a constriction in the front insertion region, this constriction being used to lock the connection lug 15.

FIG. 16 shows a side view of an insulation-displacement element 1 by way of another embodiment of the connection. A fixing tab 17 is bent out of the crosspiece 2 downward beneath the plane formed by the crosspiece 2. The fixing tab is formed from a flap of material of the crosspiece 2 which is punched out or cut out. This is shown more clearly once again in FIG. 17 which shows a sketch of a developed view of the insulation-displacement element from FIG. 16.

In this context, a very simple embodiment is also feasible, in which a hole, into which a connection pin can be inserted and possibly soldered in the hole, is formed in the crosspiece 2.

FIG. 18 shows a side view of a pair of insulation-displacement elements 1*a*, 1*b* which are integrally formed on a common crosspiece 2 and in each case have spring limbs 3 and limb ends 4 which adjoin the spring limbs 3. The design of the individual insulation-displacement elements 1*a*, 1*b* corresponds to the above-described insulation-displacement element, with the only difference being that two insulation-displacement elements 1*a*, 1*b* are positioned one behind the other on a common crosspiece in the illustrated embodiment.

In the same way, three, four or more insulation-displacement elements can be placed one behind the other in the same way.

The arrangement of the pair of insulation-displacement elements 1*a*, 1*b* on the common crosspiece 2 is shown more clearly in the perspective view from FIG. 19 and the plan view from FIG. 20.

FIG. 21 shows a perspective view of the pair of insulation-displacement elements 1*a*, 1*b* with electrical conductors 10*a*, 10*b* inserted. On account of the fact that the insulation-displacement elements 1*a*, 1*b* have spring limbs 3*a*, 3*b* and 3*c*, 3*d* which can be moved independently of one another since the insulation-displacement elements 1*a*, 1*b* are connected to one another only at the crosspiece 2, the single conductors 10*a*, 10*b* can be individually clamped in order not to influence each other.

FIG. 22 shows a sectional view of the pair of insulation-displacement elements 1*a*, 1*b* from FIG. 21. It is clear that the insulation of the electrical conductors 10*a*, 10*b* partly enters the slot recesses 9*a*, 9*b*, 9*c*, 9*d*.

The invention claimed is:

1. Insulation-displacement connection having at least one insulation-displacement element (1) with a retaining slot (5), which cuts through an insulation of an electrical conductor with which electrical contact is to be made by the insulation-displacement element (1), in a sleeve body, with the retaining slot (5) extending continuously from an insertion opening in a longitudinal direction (L) of the sleeve body and the sleeve body having a crosspiece (2) which has two mutually opposite spring limbs (3*a*, 3*b*) integrally adjoining its ends, which spring limbs merge, at their end which is opposite the crosspiece (2), into mutually facing limb ends (4*a*, 4*b*) in order to form the retaining slot (5) by way of the free longitudinal side edges of the limb ends (4*a*, 4*b*), so that a conductor accommodation space which is bounded by the spring limbs (3*a*, 3*b*) and the crosspiece (2) is created beneath the retaining slot (5), characterized in that the spring limbs (3*a*, 3*b*) in each case have at least one slot recess (9*a*, 9*b*) which extends in the direction of the limb end from the crosspiece (2) so as to leave free a longitudinal side edge of the limb ends (4*a*, 4*b*) which runs in the longitudinal direction (L), the width of the said slot recess being matched over the direction of extent to the width of the spring limb (3*a*, 3*b*) such that an effective width of the spring limb (3*a*, 3*b*), which tapers from the crosspiece (2) to the longitudinal side edge of the limb ends (4*a*, 4*b*), is produced in the longitudinal direction (L), in that the limb ends (4*a*, 4*b*) are angled away from the adjacent spring limb (3*a*, 3*b*), and in that the slot recesses (9*a*, 9*b*) extend partly into the angled-away limb ends (4*a*, 4*b*).

2. Insulation-displacement connection according to claim 1, characterized in that the 10 limb ends (4*a*, 4*b*) are rounded off at least one side edge (6*a*, 6*b*) in order to form an inlet to the retaining slot (5) which tapers in a funnel-like manner.

3. Insulation-displacement connection according to claim 1, characterized in that a pin is bent out in the crosspiece (2) downward opposite to the slot recess (9*a*, 9*b*).

4. Insulation-displacement connection according to claim 1, characterized in that the crosspiece (2) is connected to a spring clamping connection which projects away from the crosspiece (2).

5. Insulation-displacement connection according to claim 1, characterized in that at least two insulation-displacement elements (1) are arranged one behind the other on a common crosspiece (2) in the direction of extent of the retaining slot (5).

6. Insulation-displacement connection according to claim 1, characterized in that the limb ends (4*a*, 4*b*) are shorter than the crosspiece (2) with the adjoining ends of the spring limbs (3*a*, 3*b*) in the longitudinal direction (L).

7. Insulation-displacement connection according to claim 6, characterized in that the spring limbs (3*a*, 3*b*) are trapezoidal.

8. Insulation-displacement connection according to claim 1, characterized in that a connection lug is provided at least one free end of the crosspiece (2).

9. Insulation-displacement connection according to claim 8, characterized in that the connection lug is integrally formed with the crosspiece (2).

10. Insulation-displacement connection according to claim 8, characterized in that the at least one connection lug is angled away transverse to the longitudinal direction (L) approximately parallel to the plane of the crosspiece and is folded so as to point away downwards opposite to the slot recess (9*a*, 9*b*) at its end portion.

11. Insulation-displacement connection according to claim 8, characterized in that the at least one connection lug has two limbs which point away transverse to the longitudinal direction (L) and whose ends are bent over so as to face one another in order to form an accommodation slot.

12. Insulation-displacement connection according to claim 8, characterized in that the at least one connection lug is bent over so as to point away from the crosspiece downwards opposite to the slot recess (9*a*, 9*b*) and forms a solder pin.

13. Insulation-displacement connection according to claim 8, characterized in that the at least one connection lug has two sections extending transverse to the longitudinal direction (L) parallel to the plane of the crosspiece (2) with in each case an end section which extends in the longitudinal direction (L) and is folded over.

14. Insulation-displacement connection according to claim 8, characterized in that the connection lug has a clamping slot.

* * * * *

UNITED STATES PATENT AND TRADEMARK OFFICE

CERTIFICATE OF CORRECTION

PATENT NO. : 7,704,093 B2
APPLICATION NO. : 12/235930
DATED : April 27, 2010
INVENTOR(S) : Muhammet Ali Tuerkekoele et al.

It is certified that error appears in the above-identified patent and that said Letters Patent is hereby corrected as shown below:

Title Page, Item (75) Inventors should read --Muhammet Ali Tuerkekoele, Minden (DE); Hans-Josef Koellmann--

Signed and Sealed this

Eighth Day of June, 2010

David J. Kappos

David J. Kappos
*Director of the United States Patent and Trademark Office*